US005624001A

United States Patent [19]

Evans

[11] Patent Number: 5,624,001

[45] Date of Patent: Apr. 29, 1997

[54] MECHANICAL-HYDRAULIC DOUBLE-ACTING DRILLING JAR

[75] Inventor: Robert W. Evans, Marble Falls, Tex.

[73] Assignee: Dailey Petroleum Services Corp., Conroe, Tex.

[21] Appl. No.: 473,067

[22] Filed: Jun. 7, 1995

[51] Int. Cl.[6] ..... E21B 1/00

[52] U.S. Cl. ..... 175/299; 166/178

[58] Field of Search ..... 166/178; 175/296, 175/297, 299

[56] References Cited

U.S. PATENT DOCUMENTS

| | | | |
|---|---|---|---|
| Re. 3,510 | 6/1869 | Bryan . | |
| Re. 9,072 | 2/1880 | McMullen . | |
| Re. 15,760 | 2/1924 | Kammerdiner . | |
| Re. 23,354 | 5/1951 | Storm | 255/27 |
| Re. 28,768 | 4/1976 | Mason | 175/297 |
| 2,499,695 | 3/1950 | Storm | 255/27 |
| 2,551,868 | 5/1951 | Brady | 255/27 |
| 2,659,576 | 11/1953 | Linney | 255/27 |
| 2,801,595 | 8/1957 | Knabe et al. | 103/158 |
| 2,915,289 | 12/1959 | Lawrence | 255/27 |
| 2,989,132 | 6/1961 | Downen . | |
| 3,145,787 | 8/1964 | Brown | 175/107 |
| 3,208,541 | 9/1965 | Lawrence | 175/299 |
| 3,233,690 | 2/1966 | Lawrence | 175/299 |
| 3,251,426 | 5/1966 | Lebourg | 175/297 |
| 3,268,003 | 8/1966 | Essary | 166/35 |
| 3,285,353 | 11/1966 | Young | 175/297 |
| 3,307,636 | 3/1967 | Le Blanc | 173/13 |
| 3,316,986 | 5/1967 | Orr | 175/297 |
| 3,342,266 | 9/1967 | Le Blanc | 166/46 |
| 3,343,606 | 9/1967 | Dollison | 166/98 |
| 3,349,858 | 10/1967 | Chenoweth | 175/297 |
| 3,360,060 | 12/1967 | Kinley et al. | 175/299 |
| 3,361,220 | 1/1968 | Brown | 175/237 |
| 3,371,730 | 3/1968 | Newman | 175/300 |
| 3,380,247 | 4/1968 | Colmerauer | 60/52 |
| 3,385,384 | 5/1968 | Plunk | 175/297 |
| 3,392,795 | 7/1968 | Greer | 175/297 |
| 3,399,740 | 9/1968 | Barrington | 175/297 |
| 3,399,741 | 9/1968 | Monroe | 175/297 |
| 3,406,770 | 10/1968 | Arterbury et al. | 175/299 |
| 3,417,822 | 12/1968 | Howell | 166/43 |
| 3,429,389 | 2/1969 | Barrington | 175/297 |
| 3,446,283 | 5/1969 | Baumstimler | 166/311 |
| 3,461,962 | 8/1969 | Harrington | 166/226 |
| 3,539,025 | 11/1970 | Sutliff et al. | 175/297 |
| 3,562,807 | 2/1971 | Slator et al. | 175/297 |
| 3,566,981 | 3/1971 | Love | 175/297 |
| 3,642,069 | 2/1972 | Adkins | 166/301 |
| 3,648,786 | 3/1972 | Chenoweth | 175/56 |
| 3,651,867 | 3/1972 | Baumstimler | 166/99 |
| 3,658,140 | 4/1972 | Berryman | 175/304 |
| 3,660,990 | 5/1972 | Zerb et al. | 64/23 |
| 3,684,042 | 8/1972 | Graff | 175/302 |
| 3,685,598 | 8/1972 | Nutter | 175/302 |
| 3,685,599 | 8/1972 | Kisling, III | 175/304 |
| 3,709,478 | 1/1973 | Kisling, III | 267/137 |
| 3,716,109 | 2/1973 | Griffith | 175/297 |
| 3,724,576 | 4/1973 | Roberts | 175/293 |

(List continued on next page.)

*Primary Examiner*—William P. Neuder
*Attorney, Agent, or Firm*—Arnold, White & Durkee

[57] ABSTRACT

A mechanical-hydraulic double-acting drilling jar includes an inner tubular mandrel telescopingly supported inside an outer tubular housing. The mandrel and the housing each consist of a plurality of tubular segments joined together, preferably by threaded inner connections. Upper and lower pressure pistons are slidably disposed within the housing, respectively closing upper and lower substantially sealed hydraulic chambers. Longitudinal movement of the mandrel engages the collet, which in turn, translates either the upper piston or the lower piston, depending on the direction of mandrel movement. As one of the pistons is moved, fluid pressure builds in the associated hydraulic chamber, retarding further movement of the mandrel, enabling potential energy to build in the drill string. The collet is restricted from expanding until the mandrel reaches a particular point in the housing, at which time the collet expands, releasing the mandrel to rapidly collide a hammer surface thereon with an anvil surface in the housing.

12 Claims, 7 Drawing Sheets

U.S. PATENT DOCUMENTS

| | | | |
|---|---|---|---|
| 3,727,685 | 4/1973 | Chestnut et al. | 166/255 |
| 3,729,058 | 4/1973 | Roberts | 175/297 |
| 3,735,827 | 5/1973 | Berryman | 175/296 |
| 3,768,932 | 10/1973 | Svercl et al. | 417/393 |
| 3,797,591 | 3/1974 | Berryman | 175/296 |
| 3,800,876 | 4/1974 | Eggleston | 166/301 |
| 3,804,185 | 4/1974 | Mason | 175/297 |
| 3,834,471 | 9/1974 | Bottoms | 175/304 |
| 3,837,414 | 9/1974 | Swindle | 175/299 |
| 3,853,187 | 12/1974 | Sutliff et al. | 175/297 |
| 3,860,076 | 1/1975 | White | 175/294 |
| 3,877,530 | 4/1975 | Downen | 175/297 |
| 3,880,249 | 4/1975 | Anderson | 175/302 |
| 3,889,766 | 6/1975 | Sutliff et al. | 175/297 |
| 3,949,821 | 4/1976 | Raugust | 175/297 |
| 3,955,634 | 5/1976 | Slator et al. | 175/297 |
| 3,963,081 | 6/1976 | Anderson et al. | 175/304 |
| 3,987,858 | 10/1976 | Slator et al. | 175/297 |
| 3,994,163 | 11/1976 | Rogers | 73/151 |
| 4,004,643 | 1/1977 | Newman | 175/321 |
| 4,007,798 | 2/1977 | Gazda | 175/297 |
| 4,023,630 | 5/1977 | Perkin et al. | 175/297 |
| 4,036,312 | 7/1977 | DeLuish | 175/302 |
| 4,059,167 | 11/1977 | Berryman | 175/297 |
| 4,081,043 | 3/1978 | Juergens | 175/297 |
| 4,098,338 | 7/1978 | Perkins | 166/301 |
| 4,105,070 | 8/1978 | Lavigne et al. | 166/250 |
| 4,105,082 | 8/1978 | Cheek | 175/302 |
| 4,109,736 | 8/1978 | Webb et al. | 175/297 |
| 4,111,271 | 9/1978 | Perkins | 175/297 |
| 4,113,038 | 9/1978 | Clark | 175/300 |
| 4,124,245 | 11/1978 | Kuenzel | 294/86.3 |
| 4,142,597 | 3/1979 | Johnston | 175/304 |
| 4,179,002 | 12/1979 | Young | 175/297 |
| 4,181,186 | 1/1980 | Blanton | 175/297 |
| 4,186,807 | 2/1980 | Sutliff et al. | 175/302 |
| 4,210,214 | 7/1980 | Blanton | 175/297 |
| 4,211,293 | 7/1980 | Blanton | 175/297 |
| 4,226,289 | 10/1980 | Webb et al. | 175/297 |
| 4,230,197 | 10/1980 | Wenzel | 175/297 |
| 4,241,797 | 12/1980 | Allen, Jr. | 175/237 |
| 4,284,153 | 8/1981 | Reaugh | 175/297 |
| 4,333,542 | 6/1982 | Taylor | 175/299 |
| 4,341,272 | 7/1982 | Marshall | 175/65 |
| 4,346,770 | 8/1982 | Beck | 175/297 |
| 4,361,195 | 11/1982 | Evans | 175/297 |
| 4,376,468 | 3/1983 | Clark | 175/304 |
| 4,394,883 | 7/1983 | Briscoe | 175/304 |
| 4,494,615 | 1/1985 | Jones | 173/119 |
| 4,498,548 | 2/1985 | Teng | 175/299 |
| 4,566,546 | 1/1986 | Evans | 175/297 |
| 4,582,148 | 4/1986 | Walter | 175/297 |
| 4,865,125 | 9/1989 | De Cuir | 166/178 |
| 4,923,373 | 5/1990 | Rothaar et al. | 417/439 |
| 5,007,479 | 4/1991 | Pleasants et al. | 166/178 |
| 5,086,853 | 2/1992 | Evans | 175/297 |
| 5,123,493 | 6/1992 | Wenzel | 175/297 |
| 5,170,843 | 12/1992 | Taylor | 166/301 |
| 5,217,070 | 6/1993 | Anderson | 166/178 |
| 5,232,060 | 8/1993 | Evans | 175/297 |
| 5,318,139 | 6/1994 | Evans | 175/297 |
| 5,327,982 | 7/1994 | Trahan et al. | 175/304 |

FIG. 1E
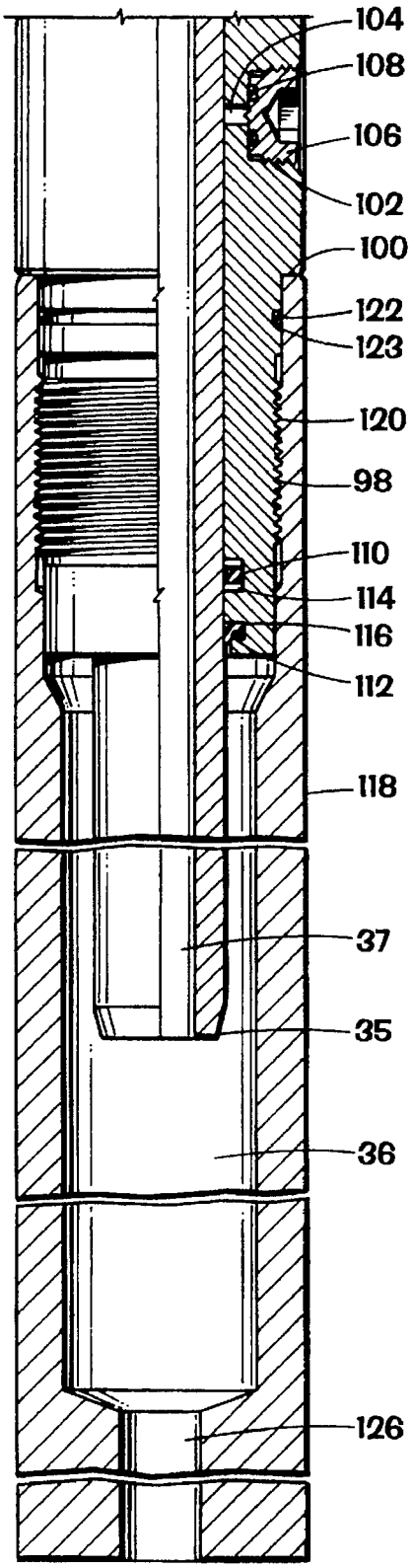
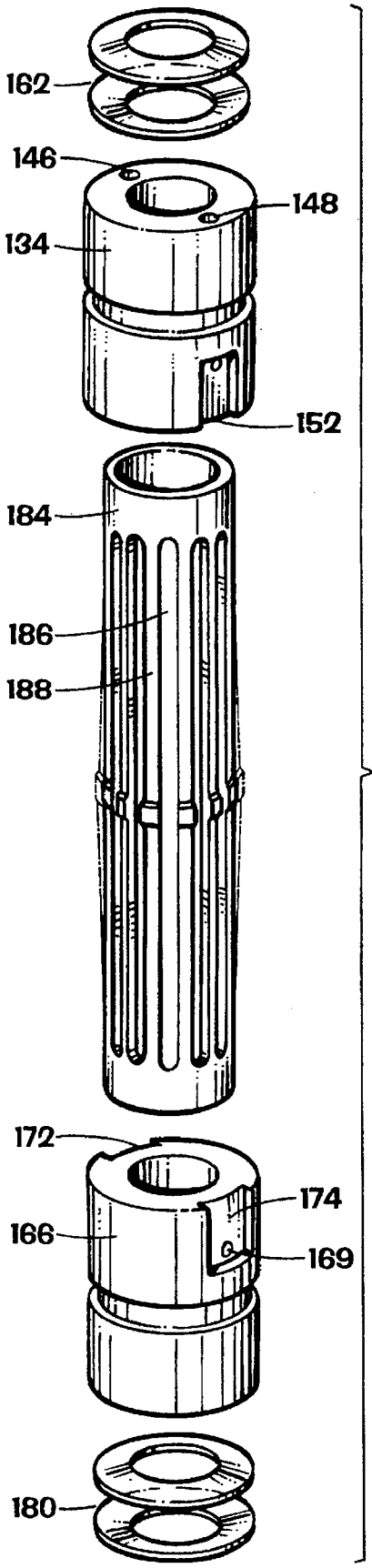
FIG. 2

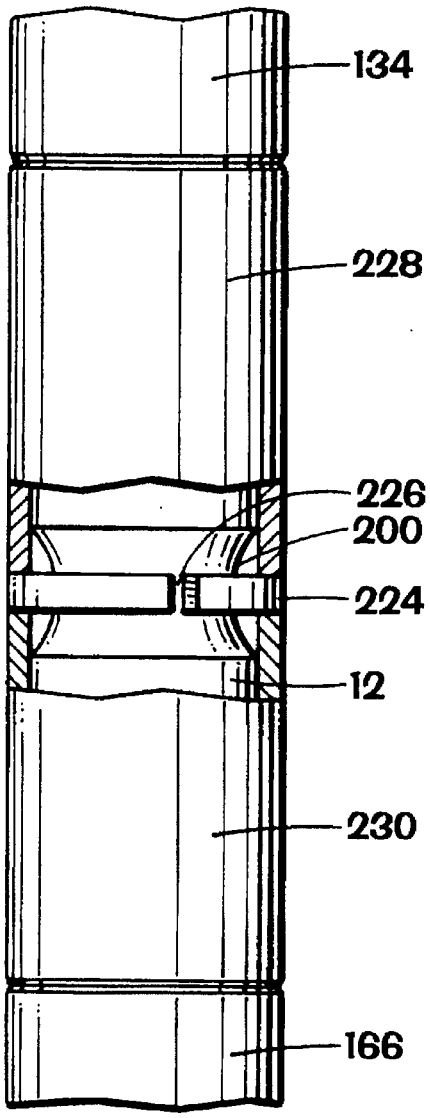
FIG. 5
FIG. 6
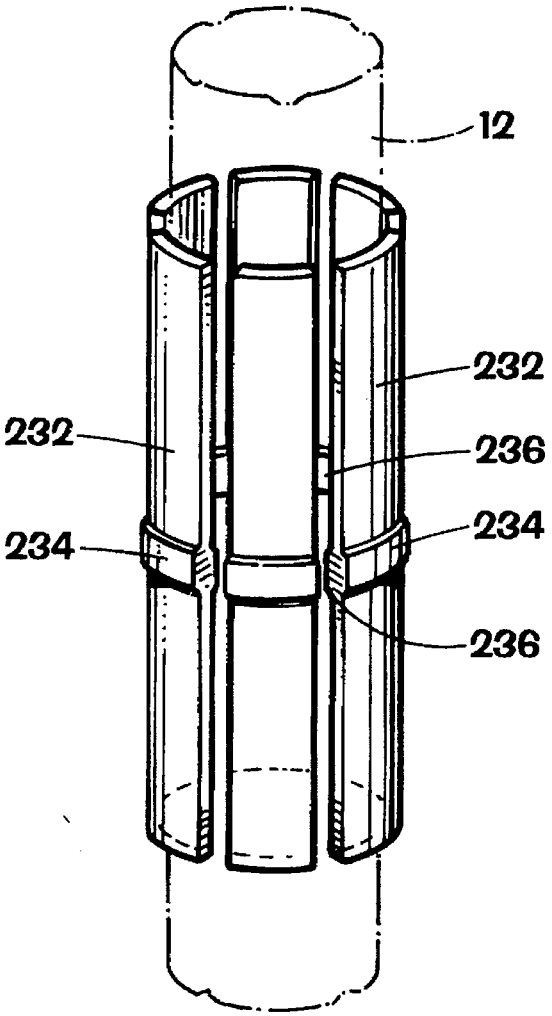

MECHANICAL-HYDRAULIC DOUBLE-ACTING DRILLING JAR

BACKGROUND OF THE INVENTION

1. Field of the Invention

This invention relates generally to drilling jars and, in particular, to a double-acting mechanical-hydraulic drilling jar.

2. Description of the Related Art

Drilling jars have long been known in the field of well drilling equipment. A drilling jar is a tool employed when either drilling or production equipment has become stuck to such a degree that it cannot be readily dislodged from the well bore. The drilling jar is normally placed in the pipe string in the region of the stuck object and allows an operator at the surface to deliver a series of impact blows to the drill string via a manipulation of the drill string. These impact blows to the drill string are intended to dislodge the stuck object and permit continued operation.

Drilling jars contain a sliding joint which allows a relative axial movement between an inner mandrel and an outer housing without allowing relative rotational movement therebetween. The mandrel typically has a hammer formed thereon, while the housing includes an anvil positioned adjacent to the mandrel hammer. Thus, by sliding the hammer and anvil together at high velocity, a substantial jarring force may be imparted to the stuck drill string, which is often sufficient to jar the drill string free. For most fishing applications it is desirable that the drilling jar be capable of providing both an upward and a downward jarring force.

There are four basic forms of drilling jars: purely hydraulic jars, purely mechanical jars, bumper jars, and mechanical-hydraulic jars. The bumper jar is used primarily to provide a downward jarring force. The bumper jar ordinarily contains a splined joint with sufficient axial travel to allow the pipe to be lifted and dropped, causing the impact surfaces inside the bumper jar to come together to deliver a downward jarring force to the string.

Mechanical, hydraulic, and mechanical-hydraulic jars differ from the bumper jar in that they contain some type of tripping mechanism which retards the motion of the impact surfaces relative to each other until an axial strain, either tensile or compressive, has been applied to the drill string pipe. To provide an upward jarring force, the drill pipe is stretched by an axial tensile load applied at the surface. This tensile force is resisted by the tripping mechanism of the jar long enough to allow the pipe to stretch and store potential energy. When the jar trips, this stored energy is converted to kinetic energy causing the impact surfaces of the jar to move together at a high velocity. To provide a downward jarring force, the pipe weight is slacked off at the surface and, if necessary, additional compressive force is applied, to put the pipe in compression. This compressive force is resisted by the tripping mechanism of the jar to allow the pipe to compress and store potential energy. When the jar trips, the potential energy of the pipe compression and pipe weight is converted to kinetic energy causing the impact surfaces of the jar to come together at a high velocity.

The tripping mechanism in most mechanical jars consists of some type of friction sleeve coupled to the mandrel which resists movement of the mandrel until the load on the mandrel exceeds a preselected amount (i.e., the tripping load). The tripping mechanism in most hydraulic jars consists of one or more pistons which pressurize fluid in a chamber in response to movement by the mandrel. The compressed fluid resists movement of the mandrel. The pressurized fluid is ordinarily allowed to bleed off at a preselected rate. As the fluid bleeds off, the piston translates, eventually reaching a point in the jar where the chamber seal is opened, and the compressed fluid is allowed to rush out, freeing the mandrel to move rapidly.

Mechanical jars and hydraulic jars each have certain advantages over the other. Mechanical drilling jars are generally less versatile and reliable than hydraulic drilling jars. Many mechanical drilling jars require the tripping load to be selected and preset at the surface to trip at one specific load after the drilling jar is inserted into the well bore. If it is necessary to re-adjust the tripping load, the drilling jar must be pulled from the well bore. Other mechanical jars require a torque to be applied to the drill string from the surface in order to trigger the jar. The applied torque to the drill string not only represents a hazard to rig personnel, but torque cannot be applied to coiled tubing drill strings. Another significant disadvantage of mechanical jars is apparent in circumstances where the jar must be placed in a cocked position prior to insertion into the well bore. Thus, in those circumstances, the tripping mechanism is subjected to stresses during the normal course of drilling if the jar is run as part of the bottom hole assembly. Finally, many mechanical jars have many surfaces that are subject to wear.

Hydraulic drilling jars offer several advantages over purely mechanical drilling jars. Hydraulic drilling jars have the significant advantage of offering a wide variety of possible triggering loads. In the typical double acting hydraulic drilling jar, the range of possible triggering loads is a function of the amount of axial strain applied by stretching or compressing the drill pipe, and is limited only by the structural limits of the jar and the seals therein. In addition, hydraulic drilling jars are ordinarily less susceptible to wear and, therefore, will ordinarily function longer than a mechanical jar under the same operating conditions. However, hydraulic drilling jars also have certain disadvantages. For example, most purely hydraulic double acting drilling jars are relatively long, in some instances having a length exceeding 25 feet. The length of a particular jar is ordinarily not a significant issue in drilling situations where regular threaded drill pipe is utilized. However, in coiled tubing applications, it is desirable that the length of all the tools in a particular drill string be no longer than the length of the lubricator of the particular coiled tubing injector. Thus, it is desirable that the drilling jar be as short as possible to enable the operator to place as many different types of tools in the drill string as possible while still keeping the overall length of the drill string less than the length of the lubricator. A conventional hydraulic drilling jar may take up one-half or more of the total length of a given lubricator, thus leaving perhaps less than half the length of the lubricator to accommodate other tools such as a mud motor, an orienting device, or a logging tool.

Many hydraulic drilling jar designs also have a disadvantageously long metering stroke. The metering stroke is the amount of relative movement between the mandrel and the housing that must occur for the jar to trigger after it is cocked by application of an axial load. When an ordinary hydraulic drilling jar is cocked by application of an axial load, fluid is pressurized in a chamber to resist relative movement of the mandrel and the housing. One or more metering orifices in the jar allow the compressed fluid to bleed off at a relatively slow rate. As the fluid is bleeding off, there is some relative axial movement between the mandrel and the housing. The amount of relative axial movement between the mandrel and the housing that occurs after the jar is cocked, but before the jar triggers, is known as bleed off. The bleed off represents lost potential energy that would ordinarily be convened into additional jarring force. Many current hydraulic drilling jar designs have a relatively long metering stroke of 12 inches or more and, therefore, a significant amount of bleed off. A long metering stroke also leads to heat buildup in the hydraulic fluid, which may require costly intervals between firings and lead to degradation of fluid.

Mechanical-hydraulic drilling jars ordinarily combine some features of both purely mechanical and purely hydraulic drilling jars. For example, one design utilizes both a slowly metered fluid and a mechanical spring element to resist relative axial movement of the mandrel and the housing. This design has the same disadvantages associated with ordinary hydraulic drilling jars, namely length, long metering stroke, and fluid heating. Another design utilizes a combination of a slowly metered fluid and a mechanical brake to retard the relative movement between the mandrel and the housing. In this design, drilling mud is used as the hydraulic medium. Therefore, the string must be pressurized before the drilling jar will operate. This pressurization step will ordinarily require a work stoppage and the insertion of a ball into the work string to act as a sealing device. After the drilling jar is triggered, the ball must be retrieved before normal operations can continue.

The present invention is intended to overcome or minimize one or more of the foregoing disadvantages.

SUMMARY OF THE INVENTION

In one aspect of the present invention, a mechanical-hydraulic double-acting drilling jar is provided. The jar includes a mandrel, a housing telescopingly positioned about the mandrel, and first and second pistons positioned between the mandrel and the housing and spaced longitudinally apart. The pistons respectively close first and second substantially sealed chambers in the housing. Each of the first and second pistons has first and second flow passages formed therein and extending therethrough. A collet is positioned between the mandrel and the housing and between the first and second pistons.

In another aspect of the present invention, a mechanical-hydraulic double-acting drilling jar is provided. The jar includes a mandrel, a housing telescopingly positioned about the mandrel, and first and second pistons positioned between the mandrel and the housing and spaced longitudinally apart. The pistons respectively close first and second substantially sealed chambers in the housing. Each of the first and second pistons has first and second flow passages formed therein and extending therethrough. There are first and second biasing members positioned between the mandrel and the housing. The first biasing member is operable to resist longitudinal movement of the first piston in a first direction and the second biasing member is operable to resist longitudinal movement of the second piston in a second direction. The second direction is opposite to the first direction. There is also a tubular collet positioned between the mandrel and the housing and between the first and second pistons.

In another aspect of the present invention, a mechanical-hydraulic double-acting drilling jar is provided. The jar includes a mandrel that has a first exterior surface and groove circumferentially disposed in the first exterior surface. A housing is telescopingly positioned about the mandrel. The housing has an interior surface that has a radially inwardly projecting third flange. The third flange has a first end forming a first shoulder and a second end forming a second shoulder. There are first and second pistons positioned between the mandrel and the housing and spaced longitudinally apart. The pistons respectively close first and second substantially sealed chambers in the housing. Each of the first and second pistons has first and second flow passages formed therein and extending therethrough. First and second biasing members are positioned between the mandrel and the housing. The first biasing member is operable to resist longitudinal movement of the first piston in a first direction and the second biasing member is operable to resist longitudinal movement of the second piston in a second direction. The second direction is opposite to the first direction. A tubular collet is positioned between the first and second pistons. The collet has an interior surface that has at least one circumferential flange projecting radially outward therefrom. The collet also has a second exterior surface that has at least one circumferential flange inwardly projecting therefrom. The collet is adapted such that the at least one inwardly projecting flange is disposed in the circumferentially disposed groove when the at least one outwardly projecting flange is in contact with the third flange, and such that the collet expands radially when the at least one outwardly projecting flange is moved past the first or second shoulders.

BRIEF DESCRIPTION OF THE DRAWINGS

Other objects and advantages of the invention will become apparent upon reading the following detailed description and upon reference to the drawings in which:

FIGS. 1A–1E illustrate successive portions, in combined quarter section and partial section, of a mechanical-hydraulic double-acting drilling jar in its neutral operating position;

FIG. 2 illustrates an exploded pictorial view of the collet, upper and lower annular pressure pistons, and biasing members from the mechanical-hydraulic double-acting drilling jar of FIGS. 1A–1E;

FIG. 5 illustrates a partial cutaway view of an alternative structure to the collet of FIG. 2.

FIG. 6 illustrates a pictorial view of another alternative structure to the collet of FIG. 2.

DESCRIPTION OF THE PREFERRED EMBODIMENT

Figure 1A:
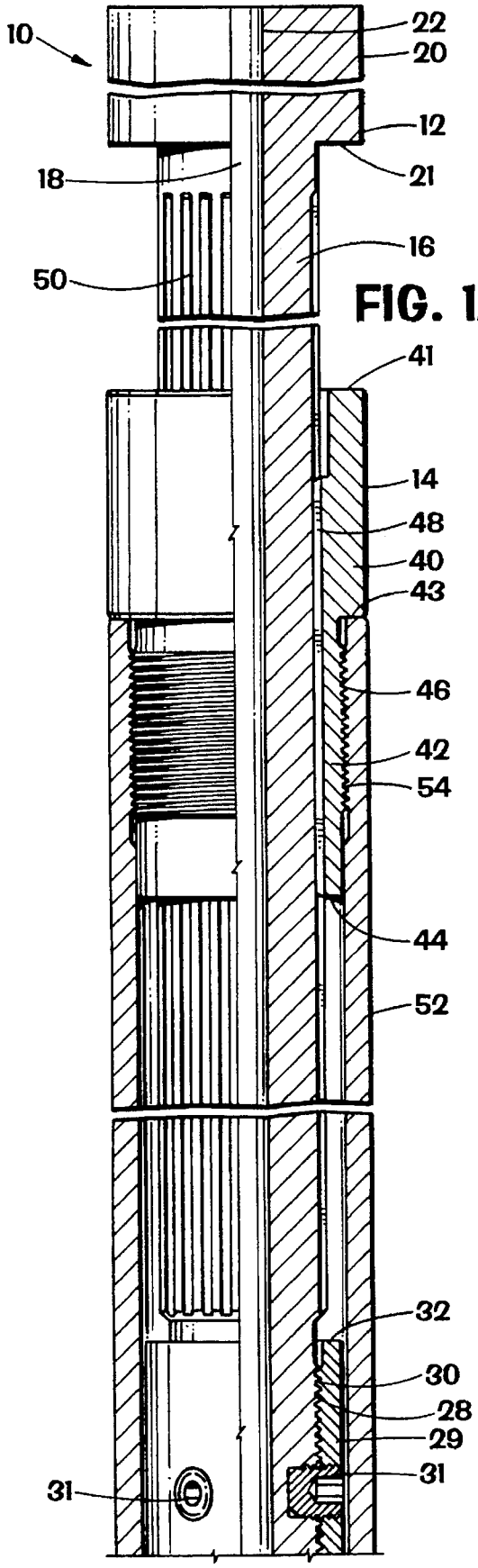
Figure 1B:
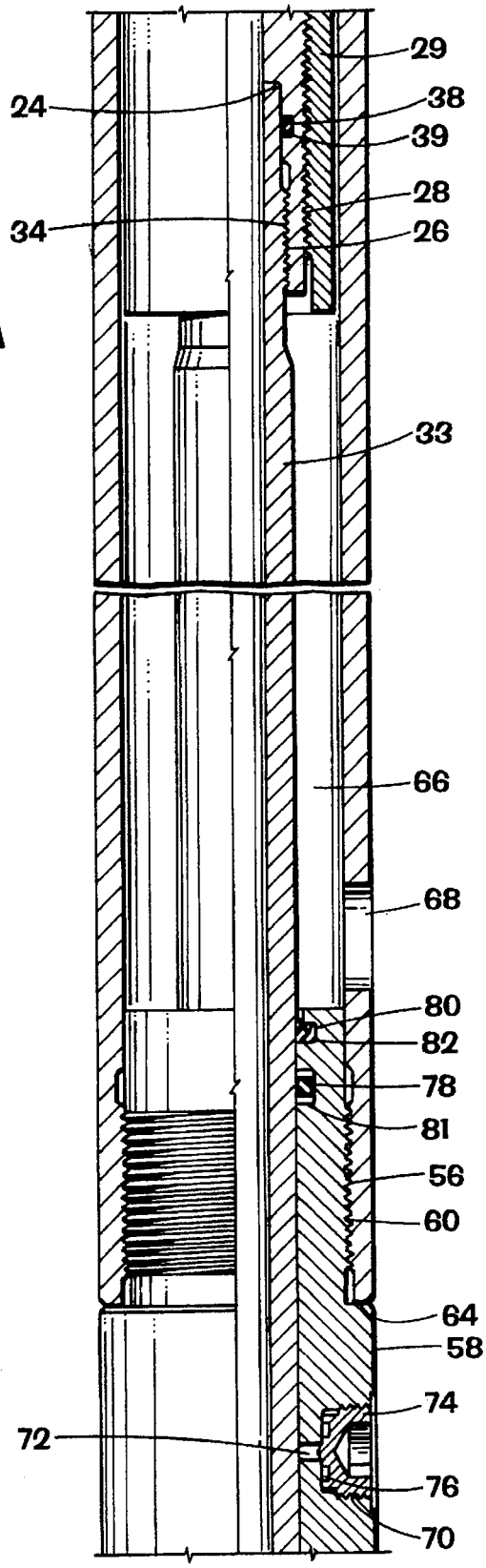

Referring now to the drawings, and, in particular to FIGS. 1A–1E, inclusive, there is shown a mechanical-hydraulic double-acting drilling jar 10 which is of substantial length necessitating that it be shown in five longitudinally broken partial sectional views, vis-a-vis FIGS. 1A, 1B, 1C, 1D, and 1E. Each of these views depicts the right half of the drilling jar 10 in a quarter sectional view, and the left half of the drilling jar 10 in a cutaway view. The drilling jar 10 generally comprises an inner tubular mandrel 12 telescopingly supported inside an outer tubular housing 14. The mandrel 12 and the housing 14 each consist of a plurality of tubular segments joined together, preferably by threaded inner connections.

The mandrel 12 consists of an upper tubular portion 16 having an inner longitudinal passage 18 extending therethrough. The upper end of the tubular portion 16 is enlarged as indicated at 20 so as to form a substantially flat shoulder or downward hammer surface 21, and is internally threaded at 22 for connection to a conventional drill string or the like (not shown). The lower end of the upper tubular portion 16 is provided with a counter bore ending in an internal shoulder 24 and is internally threaded as indicated at 26 and externally threaded as indicated at 28. An annular hammer 29 is disposed about the upper tubular portion 16 and is internally threaded, as indicated at 30, for engagement with the upper tubular portion 16 at 28. Two or more circumferentially spaced lock screws 31 also bind the annular hammer 29 to the upper tubular portion 16 to prevent relative rotational movement therebetween. The lock screws 31 are sunk to present a flush surface with the exterior of the annular hammer 29. The annular hammer 29 has a substantially flat upper hammer surface 32 at its upper end.

An intermediate portion of the mandrel 12 consists of a tubular portion 33 which has its upper end threaded as indicated at 34 for connection inside the threaded portion 26 of the upper tubular portion 16 with the upper end portion abutting the shoulder 24.

The lower end 35 of the tubular portion 16 terminates in a cylindrical chamber 36 in the housing 14 and is provided with an internal bore or passage 37, which is a continuation of the passage 18 in the upper tubular portion 16. An O-ring 38 disposed in an annular recess 39 in the lower end of the upper tubular portion 16 provides a fluid seal between the upper tubular portion 16 and the tubular portion 33.

The tubular housing 14 is formed in several sections for purposes of assembly, somewhat similar to the mandrel 12. The upper end of the tubular housing 14 consists of an upper tubular portion 40. The upper end of the upper tubular portion 40 has a substantially flat downward anvil surface 41 for engagement with the downward hammer surface 21, as discussed more below. The lower portion of the upper tubular portion 40 is provided with an external counter bore 42 that has a shoulder 43. The lower end of the external counter bore 42 terminates in an upward anvil surface 44 for engagement with the upward hammer surface 32, as discussed more below. The counter bore 42 is externally threaded at 46. The interior surface of the tubular portion 40 has a plurality of inwardly facing circumferentially spaced splines 48. The splines 48 are configured to mate with a matching set of outwardly projecting circumferentially spaced splines 50 on the exterior surface of the upper tubular portion 16 of the mandrel 12. The sliding interaction of the splines 48 and the splines 50 provide for relative sliding movement of the mandrel 12 and the housing 14 without relative rotational movement therebetween. The tubular housing 14 is provided with an intermediate tubular member 52 which is internally threaded, as indicated at 54, at its upper end for connection to the threaded portion of the tubular member 40. The upper end of the intermediate tubular portion 52 abuts the shoulder 43 when the threaded connection at 46 and 54 is securely tightened. The lower end of the intermediate portion 52 is internally threaded as indicated at 56.

The tubular housing 14 is provided with an intermediate tubular member 58 that is externally threaded, as indicated at 60, at its upper end for connection to the threaded portion 56 of the intermediate tubular member 52, and is externally threaded, as indicated at 62, at its lower end for connection to another tubular portion of the tubular housing to be discussed below. The upper end portion of the intermediate tubular member 58 has a portion of reduced diameter forming a shoulder 64 which abuts the lower end of the intermediate tubular portion 52 when the threaded connection at 56 and 60 is securely tightened. The lower end portion of the intermediate tubular member 58 also has a portion of reduced diameter forming a shoulder 65 which abuts another intermediate tubular member discussed below.

There is an annular chamber 66 that is formed within the intermediate tubular portion 52 between the upper end of the intermediate tubular portion 58 and the lower ends of the annular hammer 29 and the lower portion of the upper tubular portion 16 of the mandrel 12. The annular chamber 66 is vented to the well annulus (not shown) by way of a port 68 in the intermediate tubular portion 52.

The intermediate tubular portion 58 is provided with a fill port 70 to permit introduction of a suitable operating fluid, e.g., hydraulic fluid into the drilling jar 10. The filling port 70 is counter sunk with a fill passage 72 leading into the drilling jar 10, and has a threaded opening that is capped with a fill plug 74 that is threadedly connected to the intermediate tubular member 58. The plug 74 has an O-ring 76 to act as a seal.

It is desirable to both prevent mud or other material from the well annulus from contaminating the jar operating fluid, and to prevent loss of jar operating fluid into the well annulus. Accordingly, the upper end of the intermediate tubular portion 58 includes a seal arrangement that consists of an O-ring 78 and a wiper 80 that is disposed just above the O-ring 78, that are disposed respectively in annular recesses 81 and 82 in the intermediate tubular portion 58, and are both in contact with the intermediate tubular member 33. Similarly, to prevent flow of jar operating fluid past the threaded portion 62, an O-ring 83 is disposed at the lower end of the intermediate tubular portion 58.

The tubular housing 14 is provided with an intermediate tubular member 84 which is internally threaded as indicated at 86 at its upper end for a threaded connection to the threaded portion 62 of the intermediate tubular member 58. The intermediate tubular member 84 is internally threaded at its lower end as indicated at 88 to threadedly connect to another tubular member as discussed more fully below. The upper end of the intermediate tubular member 84 abuts the shoulder 65 on the intermediate tubular member 58 when the threaded interconnection at 62 and 86 is securely tightened.

The tubular housing 14 is provided with an intermediate tubular member 90 that is externally threaded at its upper end, as indicated at 92, for connection to the threaded portion 88 of the intermediate tubular member 84. The upper end of the intermediate tubular member 90 has a portion of reduced diameter forming a shoulder 94 that abuts the lower end of the intermediate tubular member 84 when the threaded connection at 88 and 92 is securely tightened. An O-ring 96 is disposed in a recess 97 in the upper end of the intermediate tubular member 90 to prevent leakage of hydraulic fluid past the threaded connection at 88 and 92. The lower end of the intermediate tubular member 90 has a portion of reduced diameter that is externally threaded, as indicated at 98, and forms a shoulder 100. The intermediate tubular member 90 has a fill port 102 to enable the operator to fill the drilling jar 10 with hydraulic fluid. The filling port 102 is counter sunk to provide a flow passage 104 leading to the interior of the drill jar 10, and a larger diameter opening that is capped by a threadedly connected plug 106. The plug 106 has an O-ring seal that engages the intermediate tubular member 90 proximate the fill passage 104.

It is desirable to both prevent the contamination of the hydraulic fluid in the drilling jar 10 by material, such as drilling mud, emanating from the bore 36 and to prevent the loss of hydraulic fluid from the drilling jar 10 at the interface between the intermediate tubular member 90 and the lower end of the mandrel 12. Accordingly, the intermediate tubular member 90 includes at its lower end a seal arrangement that is substantially similar to the seal arrangement for the intermediate tubular member 58, and which consists of an O-ring 110 and a wiper 112 disposed in annular recesses 114 and 116 in the intermediate tubular member 90. The wiper 112 is disposed just below the O-ring 110.

The lower end of the tubular housing 14 consists of a lower tubular member 118 that is internally threaded at its upper end as indicated at 120 for connection to the threaded portion 98 of the intermediate tubular member 90. The upper end of the lower tubular member 118 abuts the shoulder 100 of the intermediate tubular member 90 when the threaded connection at 98 and 120 is securely tightened. To prevent the escape of mud or other material emanating from the bore 36, an O-ring 122 is disposed in an annular recess 123 in the lower end of the intermediate tubular member 90 proximate the upper end of the lower tubular member 118. The clearance between the upper end of the lower tubular member 118 and the lower end 35 of the mandrel 12 is such that the cylindrical chamber 36 is large enough to accommodate the movement of the lower end 35 of the mandrel 12 therein while at the same time accommodating a quantity of pressurized fluid, such as drilling mud. The lower end of the annular chamber 36 is continuous with a reduced diameter flow passage 126 that extends and opens to the bottom of the drilling jar (not shown). The bottom (not shown) of the drilling jar 10 may be internally or externally threaded as the case may be to connect to another portion of the drill string (not shown).

An inner surface 128 of the intermediate tubular member 84 and an outer surface 130 of the tubular portion 33 of mandrel 12 are spaced apart to define an upper hydraulic chamber 132. Generally, the upper hydraulic chamber 132 resists upward movement of the mandrel 12 relative to the housing 14. That is, upward relative movement of the mandrel 12 relative to the housing 14 reduces the volume of the upper hydraulic chamber 132, causing a significant increase in the internal pressure of the upper hydraulic chamber 132, thereby producing a force to resist this relative movement. This resistance to relative movement allows a large buildup of potential energy.

Accordingly, a mechanism is provided for substantially sealing the upper hydraulic chamber 132 to permit the buildup of pressure therein. The surfaces 128 and 130 of the upper hydraulic chamber 132 are smooth cylindrical surfaces permitting free movement of an upper annular pressure piston 134. The upper annular pressure piston 134 has a smooth cylindrical bore 136 through which the mandrel 12 is slidably journalled. The upper annular piston 134 is sealed against leakage past the bore 136 by an O-ring 138 disposed in an annular recess 139 in the lower end of the upper annular pressure piston 134, and against leakage between the exterior surface 140 of the upper annular piston 134 and the interior surface 128 by an O-ring 142 that is disposed in an annular recess 143 in the upper annular pressure piston 134.

The interior surface 128 of the intermediate tubular member 84 has a reduced diameter section that has at its upper end an upward facing annular shoulder 144 and at its lower end a downward facing annular shoulder 145. The upward facing annular shoulder 144 is engagable with the lower end of the upper annular pressure piston 134 to define the limit of downward movement of the upper annular pressure piston 134. Similarly, the downward facing shoulder 145 is engagable with another annular pressure piston to define the limit of upward movement thereof, as discussed below.

Referring now also to FIG. 2, which is an exploded pictorial view showing the upper and lower annular pressure pistons 134 and 166 and other components to be described below, the upper annular pressure piston 134 has two substantially parallel flow passages 146 and 148 extending therethrough. The first flow passage 146 is in fluid communication at its upper end with the upper hydraulic chamber 132 and in fluid communication at its lower end with a slot 149 formed in the exterior of the lower end of the upper annular pressure piston 134. The first flow passage 146 is designed to permit restricted flow of fluid from the upper hydraulic chamber 132 to permit buildup of pressure in the upper hydraulic chamber 132 while permitting the upper annular pressure piston 134 to translate upwards until the jar 10 triggers, as described more below. To that end, the upper portion of the first flow passage 146 includes a conventional flow restriction orifice 150 to restrict the flow of fluid from the upper hydraulic chamber 132. The flow restriction orifice 150 is preferably a Lee JEVA, manufactured by Lee Company, Westbrook, Conn., or other suitable orifice.

Like the first flow passage 146, the second flow passage 148 is in fluid communication at its upper end with the upper hydraulic chamber 132 and in fluid communication at its lower end with a slot 152 formed in the exterior of the lower end of the upper annular pressure piston 134. The second flow passage 148 is designed to prevent flow of fluid from the upper hydraulic chamber 132 through the upper annular pressure piston 134 during upward movement of the upper annular pressure piston 134 while permitting a free flow of fluid in the reverse direction during downward movement of the upper annular pressure piston 134. To that end, the flow passage 148 includes a conventional one way flow valve 154, shown schematically as a ball valve, to permit flow of fluid in the direction indicated by the arrow 156. The one way flow valve 154 is preferably a Lee Chek model 187, manufactured by the Lee Company, Westbrook, Conn., or other suitable one way flow valve.

Note that both the flow passages 146 and 148 terminate at their lower ends in a 90° elbow. This configuration is necessary only to avoid the O-ring 142. It should be understood that the flow passages 146 and 148 may alternately extend through the entire length of the piston 134, thus obviating the need for the 90° elbow and the slots 147 and 152.

There is a biasing member 162 disposed in the upper hydraulic chamber 132, through which the mandrel 12 is journalled. The upper end of the biasing member 162 bears against the lower end of the intermediate tubular member 58, and the lower end of the biasing member 162 bears against the upper end of the upper annular pressure piston 134. As discussed more fully below, the biasing member 162 functions to resist upward movement of the upper annular pressure piston 134 and to return the upper annular pressure piston 134 to the position shown in FIG. 1C after an upward jarring movement of the drilling jar 10. The biasing member 162 is preferably a stack of bellville springs, though other types of spring arrangements may be possible, such as one or more coil springs. Regardless of the particular design chosen, it is desirable in one preferred embodiment that the biasing member 162 provide a minimum of approximately 250 pounds of force when fully compressed.

The inner surface 128 of the intermediate tubular member 84 and the outer surface of the mandrel 12 are spaced apart to define a lower hydraulic chamber 164, which is substantially similar to the upper hydraulic chamber 132. Like the upper hydraulic chamber 132, the lower hydraulic chamber 164 resists longitudinal movement of the mandrel 12. However, in this case the lower hydraulic chamber 164 resists downward longitudinal movement of the mandrel 12. A lower annular pressure piston 166 is disposed within the housing 14 to substantially seal the lower hydraulic chamber 164 to permit the buildup of pressure therein.

The lower annular pressure piston 166 is substantially similar in structure to the upper annular pressure piston 134. However, the lower annular pressure piston 166 is inverted in comparison to the upper annular pressure piston 134. The lower annular pressure piston 166 includes two flow passages 168 and 169 that extend therethrough. The first flow passage 168 is in fluid communication with both the lower hydraulic chamber 164 and a slot 172 in the piston 166, and contains a conventional flow restriction orifice 173. The second flow passage 169 is in fluid communication with both the lower hydraulic chamber 164 and a slot 174 in the piston 166, and contains a conventional one way flow valve 175 that permits flow in the direction indicated by the arrow 176. The lower annular pressure piston 166 has O-rings 177 and 178 that are identical in structure and operation to O-rings 142 and 138. As noted above, the upper end of the lower annular pressure piston 166 is engagable with the downward facing shoulder 145, which defines the limit of upward movement thereof.

The downward movement of the lower annular pressure piston 166 is retarded not only by the pressure of hydraulic fluid compressed within the lower hydraulic chamber 164, but also by a biasing member 180 that is disposed in the lower hydraulic chamber 164 and through which the mandrel 12 is journalled. The upper end of the biasing member 164 abuts the lower end of the lower annular pressure piston 166. The lower end of the biasing member 180 abuts the upper end of the intermediate tubular member 90. The biasing member 180 is substantially identical to the biasing member 162 in structure and function.

It should be appreciated that the upper annular pressure piston 134, in conjunction with the fluid pressure in the upper hydraulic chamber 132 and the biasing member 162, function to retard the upward movement of the mandrel 12 to allow a buildup of potential energy in the drill string when a tensile load is placed on the mandrel 12 from the surface. Similarly, it should be appreciated that the downward movement of the mandrel 12 is restricted by the lower annular pressure piston 166 acting in concert with the fluid pressure within the lower hydraulic chamber 164 and the biasing member 180 to allow a buildup of potential energy in the drill string when a compressive load from the surface is applied to the mandrel 12. The transmission of an upward acting force from the mandrel 12 to the upper annular pressure piston 134 and the transmission of a downward acting force from the mandrel 12 to the lower annular pressure piston 166 requires a mechanical linkage between the mandrel 12 and the upper and lower annular pressure pistons 134 and 166. The mechanical linkage is provided by a generally tubular collet 184 which is disposed in the intermediate tubular section 84 between the upper annular pressure piston 134 and the lower annular pressure piston 166. The mandrel 12 is journalled through the collet 184.

Figure 1C:
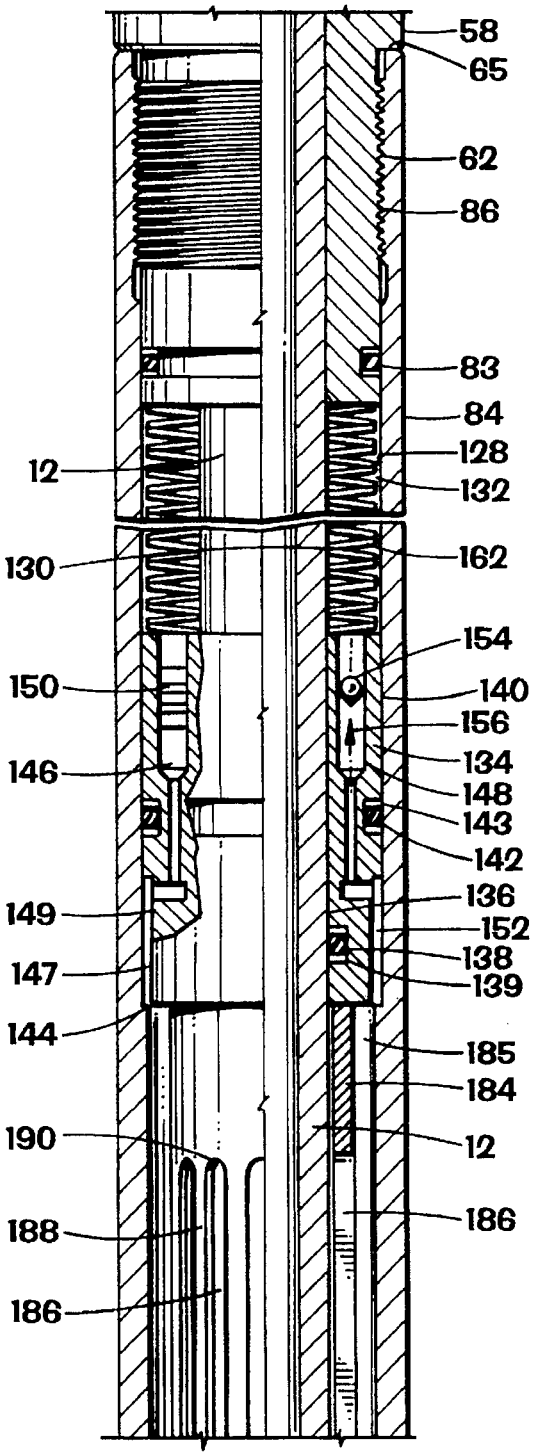
Figure 1D:
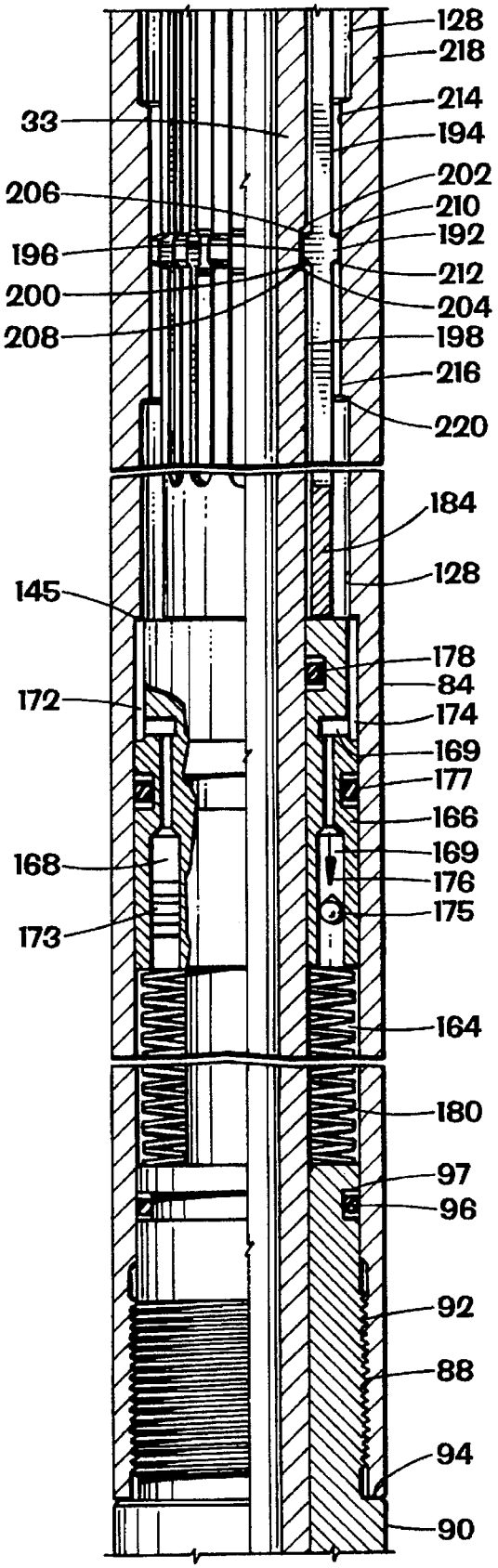

The collet 184 has a plurality of longitudinally extending and circumferentially spaced slots 186 that divide the central portion of the collet 184 into a plurality of longitudinally extending and circumferentially spaced segments 188. During operation of the drilling jar 10, the segments 188 will be subjected to bending stresses. Accordingly, it is desirable to round the ends 190 of the slots 186 to avoid creating stress risers. Each longitudinal segment 188 has an outwardly projecting flange 192 formed on the exterior surface 194 thereof and an inwardly projecting flange 196 formed on the interior surface 198 thereof and proximate the outwardly projecting flange 192. It should be understood that the collet 184 need not have a fully annular horizonal cross section as shown in FIGS. 1C–1D, inclusive, and FIG. 2. The collet may be less than fully annular, e.g., formed to have a semicircular horizontal cross section. Accordingly, the number and spacing of segments 188 may be varied.

A portion of the mandrel 12 that is journalled through the collet 184 has an annular recess 200 formed therein that extends around the circumference thereof. The annular recess 200 has an upper tapered shoulder 202 and a lower tapered shoulder 204. Each of the inwardly projecting flanges 196 has an upper bevelled surface 206 and a lower bevelled surface 208. An upward acting force on the mandrel 12 is transmitted to the collet 184, and thus, in turn, to the upper annular pressure piston 134, by the interaction between the shoulder 204 and the lower bevelled surfaces 208. Conversely, a downward acting force on the mandrel 12 is transmitted to the collet 184, and thus, in turn, the lower annular pressure piston 166, by the interaction between the shoulder 202 and the upper bevelled surfaces 206.

The outwardly projecting flanges 192, which have an upper bevelled surface 210 and a lower bevelled surface 212, engage the relatively smooth inner surface 214 of an inwardly projecting annular flange 216 that projects inwardly from the inner surface 128 of the intermediate tubular member 84. The inwardly projecting flange 216 has at its upper end a bevelled shoulder 218 and at its lower end a bevelled shoulder 220.

In the unloaded or neutral condition depicted in FIGS. 1A–1E, inclusive, the collet 184 is positioned so that the outwardly projecting flanges 192 are positioned at approximately the center point of the inwardly projecting annular flange 216. The collet 184 is urged to remain in this central position by the biasing action of the biasing members 162 and 180, which transmit their respective compressive forces against the collet 184 via the upper and lower annular pressure pistons 134 and 166.

The collet 184 functions not only as a linkage for the transmission of upward and downward forces from the mandrel 12 to the upper and lower annular pressure pistons 134 and 166, but also serves as the triggering mechanism to free the mandrel 12 to move rapidly relative to the housing 14.

As discussed more fully below, the drilling jar 10 will trigger in an upward jarring mode when the lower bevelled surface 212 is moved past the bevelled shoulder 218. Conversely, the drilling jar 10 will trigger in a downward jarring mode when the upper bevelled surface 210 passes the lower bevelled shoulder 220.

UPWARD JARRING MOVEMENT

Figure 3A:
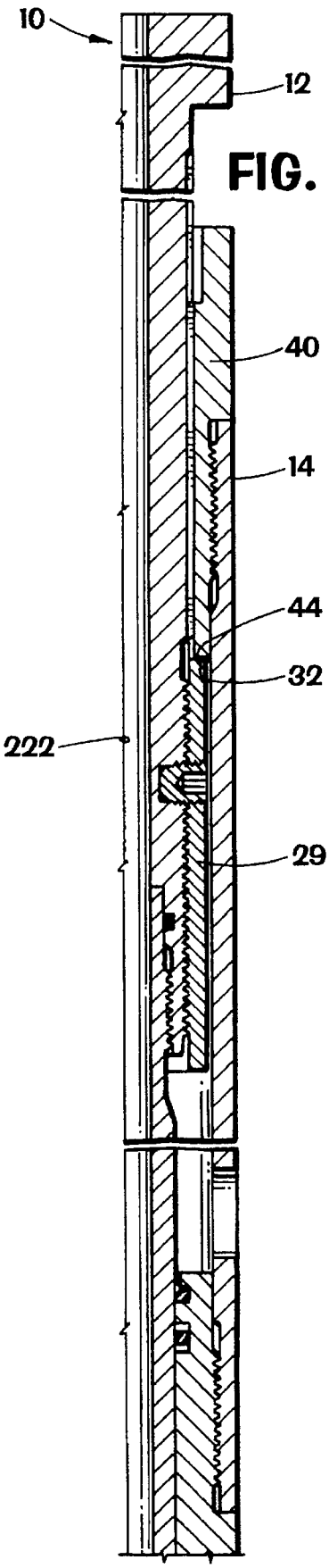
FIGS. 3A–3C illustrate successive portions, in quarter section, of the mechanical-hydraulic double-acting drilling jar of FIGS. 1A–1E in its post-triggered upward jarring position.
Figure 3B:
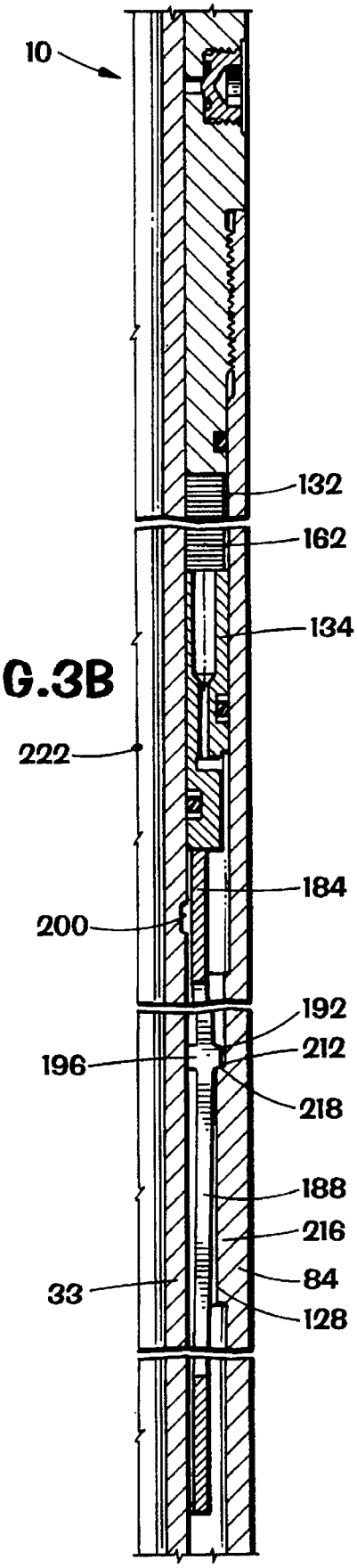
Figure 3C:
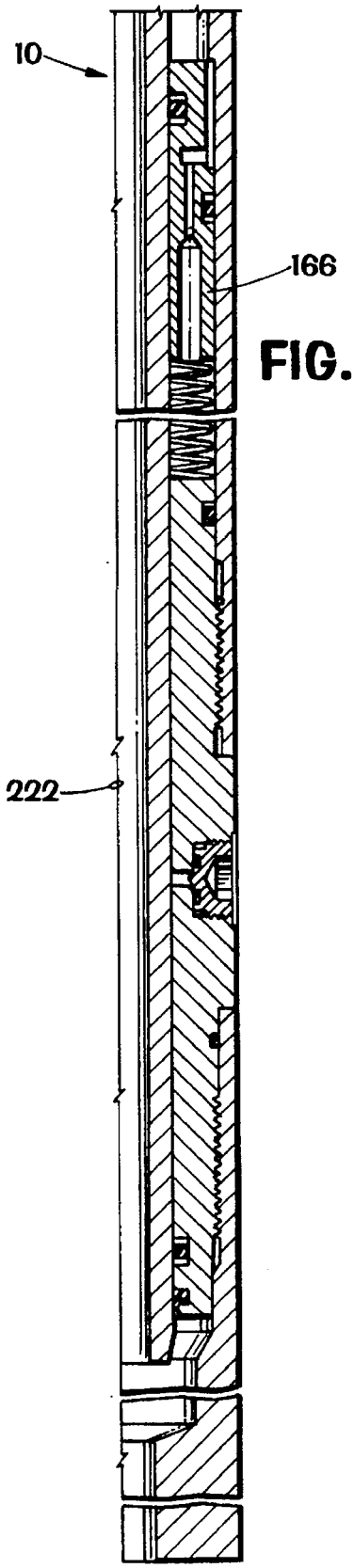

The upward jarring movement capability of the drilling jar 10 can be understood by reference to FIGS. 1A–1E, inclusive, and FIGS. 3A–3C, inclusive. FIGS. 3A–3C, inclusive, show the drilling jar 10 just after it has fired in an upward jarring movement. Each of FIGS. 3A–3C is shown in a longitudinal quarter section extending from the center line 222 of the jar 10 to the outer periphery thereof. In an unloaded condition, the drilling jar 10 is in a neutral position as depicted in FIGS. 1A–1E, inclusive. To initiate an upward jarring movement of the drilling jar 10, an upwardly directed tensile load is applied to the mandrel 12. The range of permissible magnitudes of tensile loads, and thus imparted upward jarring force, is limited only by the structural limits of the jar 10 and the seals therein. As force is applied to the mandrel 12, the lower shoulder 204 of the recess 200 engages the lower bevelled surfaces 208 of the inwardly projecting flanges 196 of the collet 184. The upward acting force from the mandrel 12 is transmitted to the collet 184, and in turn to the upper annular pressure piston 134, urging both the collet 184 and the upper annular pressure piston 134 upwards. As the upper annular pressure piston 134 is translated upwards, the fluid within the upper hydraulic chamber 132 is compressed. The upward movement of the upper annular pressure piston 134, and in turn the collet 184 and the mandrel 12 are retarded by the pressure of the fluid compressed within the upper hydraulic chamber 132 and by the downward acting force of the biasing member 162 acting on the upper end of the upper annular pressure piston 134, allowing potential energy in the drill string to build. As noted above, upward movement of the upper annular pressure piston 134 is accommodated by a restricted flow of hydraulic fluid from the upper hydraulic chamber 132 through the first flow passage 146. The upper annular pressure piston 134, the collet 184, and the mandrel 12 continue a steady but slow upward creep as fluid continues to flow from the upper hydraulic chamber 132 through the upper annular pressure piston 134, and into the space between the upper and lower annular pressure pistons 134 and 166. When the lower bevelled surface 212 on the outwardly projecting flanges 192 reach the upper shoulder 218 on the inwardly projecting annular flange 216, there will be a wedging action between the lower shoulder 204 of the annular recess 200 and the lower bevelled surface 208 of the inwardly projecting flange 196 that will cause the segments 188 to bend radially outward. The spacing between the inner surface 128 of the intermediate tubular member 84 and the exterior of the intermediate portion 33 of the mandrel 12 is such that the segments 188 may expand radially outward enough to clear the inwardly projecting flanges 196 from the annular recess 200, thereby allowing the mandrel 12 to translate upwards freely and rapidly relative to the housing 14. Without the strictures of the collet 184 and the upper annular pressure piston 134, the mandrel 12 accelerates upward rapidly bringing the hammer surface 32 of the upper hammer 29 rapidly in contact with the anvil surface 44 of the upper anvil 40. Note that the lower annular pressure piston 166 is held substantially in its neutral position during upward jarring by the shoulder 145.

The collet 184 provides for a relatively short firing, or metering stroke. For an upward jarring movement, the metering stroke is defined approximately by the distance between the lower bevelled surfaces 212 on the outwardly projecting flanges 192 and the upper shoulder 218 on the inwardly projecting annular flange 216. Similarly, the metering stroke for a downward jarring movement is approximately defined by the distance between the upper bevelled surface 210 on the outwardly projecting flanges 192 and the lower shoulder 220 on the inwardly projecting annular flange 216. This relatively short metering stroke serves two useful functions. First, the short metering stroke minimizes the amount of bleed off, or lost potential energy, that is associated with long metering strokes. Secondly, the short metering stroke minimizes the amount of hydraulic fluid that must be rapidly past through flow passages, thereby reducing heat buildup in the fluid.

To reset the drilling jar 10 to its neutral position, the mandrel 12 is moved downward relative to the housing 14. As the mandrel 12 is moved downward, the upper shoulder 202 of the annular recess 200 engages the upper bevelled surface 206 of the inwardly projecting flanges 196. Via a wedging interaction between the lower bevelled surface 212 and the upper shoulder 218, the segments 188 contract radially inward until the outwardly projecting flanges 192 slidably engage the inner surface 214 of the inwardly projecting annular flange 216. As the mandrel 12 is translated downwards, the upper annular pressure piston 134 is urged downward with relative ease by the biasing member 162. This freedom of movement is made possible by the one way flow valve 154 in the upper annular pressure piston 134, which allows a relatively free flow of fluid from the space between the upper and lower annular pressure pistons 134 and 166 through the upper annular pressure piston 134 and into the upper hydraulic chamber 132.

DOWNWARD JARRING MOVEMENT

Figure 4A:
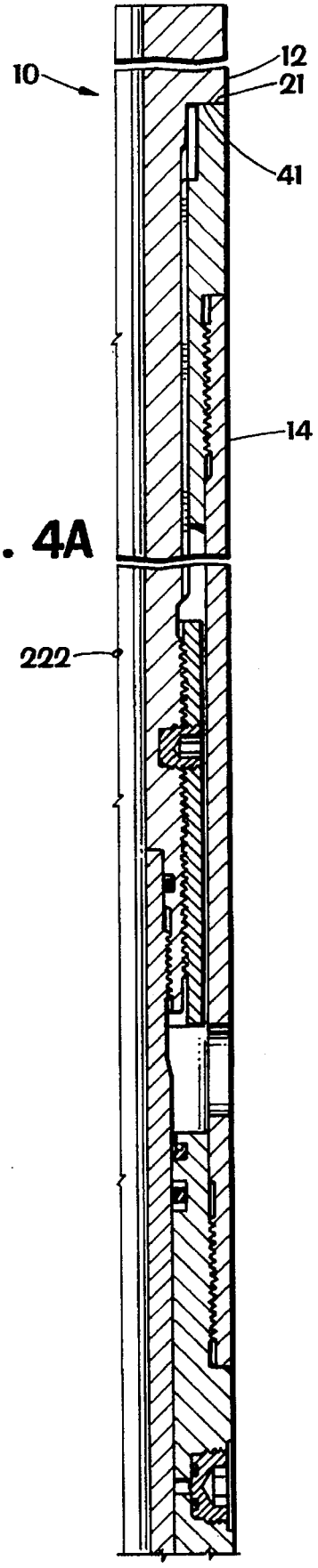
FIGS. 4A–4C illustrate successive portions, in quarter section, of the mechanical-hydraulic double-acting drilling jar of FIGS. 1A–1E in its post-triggered downward jarring position.
Figure 4B:
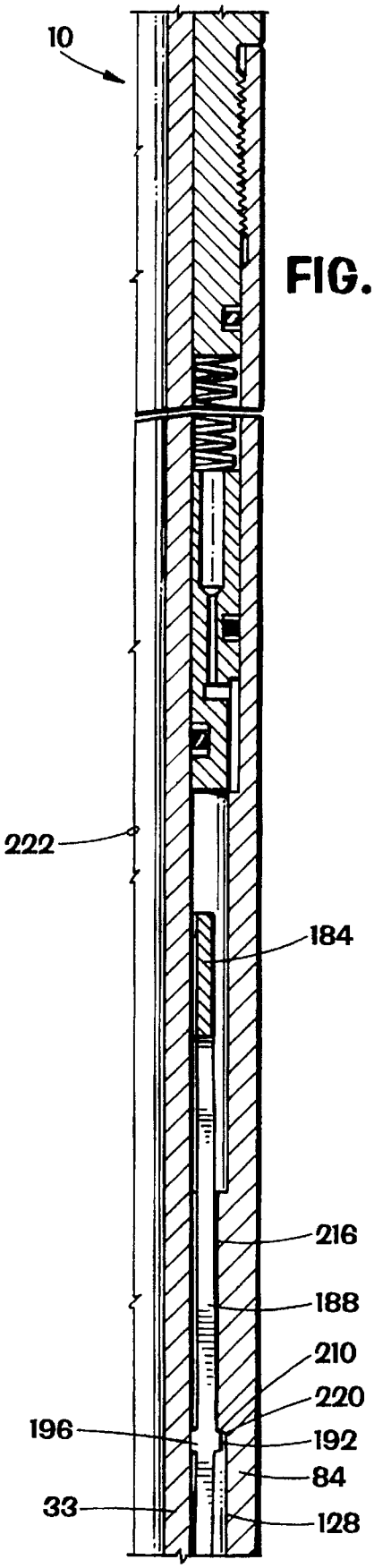
Figure 4C:
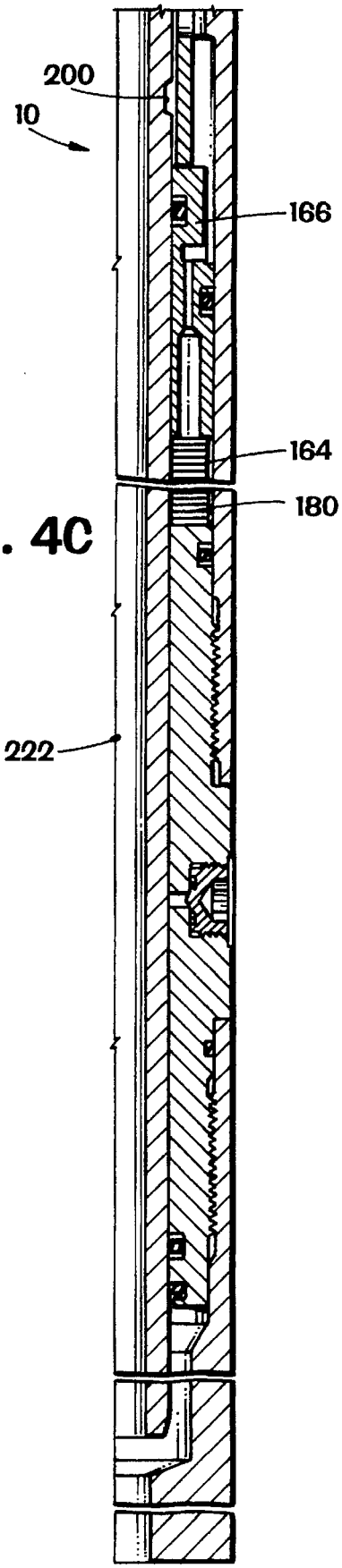

The downward jarring movement capability of the drilling jar 10 can be understood by reference to FIGS. 1A–1E, inclusive, and FIGS. 4A–4C, inclusive. FIGS. 4A–4C, inclusive, show the drilling jar 10 just after it has fired in a downward jarring movement. Each of FIGS. 4A–4C is shown in a longitudinal quarter section extending from the center line 222 of the jar 10 to the outer periphery thereof. In an unloaded condition, the drilling jar 10 is in a neutral position as depicted in FIGS. 1A–1E, inclusive. To initiate a downward jarring movement of the drilling jar 10, a compressive load is applied to the mandrel 12. The range of permissible magnitudes of compressive loads, and thus downward jarring force, is limited only by the structural limits of the jar 10 and the seals therein. When the mandrel 12 is urged downward, the upper shoulder 202 in the annular recess 200 engage the upper bevelled surfaces 206 on the inwardly projecting flanges 196, thereby urging the collet 184, and therefore the lower annular pressure piston 166 downward. As the lower annular pressure piston 166 is urged downward, the fluid in the lower hydraulic chamber 164 is compressed. The combination of the compression of the fluid in the lower hydraulic chamber 164 and the opposing force from the compressed biasing member 180 act in concert to retard the movement of the lower annular pressure piston 166, and therefore the collet 184 and the mandrel 12, allowing potential energy in the drill string to build. When the upper bevelled surfaces 210 of the outwardly projecting flanges 192 clear the lower shoulder 220 of the inwardly projecting annular flange 216, a wedging interaction between the upper shoulder 202 and the upper bevelled surfaces 206 of the inwardly projecting flanges 196 urges the segments 188 to bend radially outward. As with the upper jarring movement, the spacing between the inner surface 128 and the exterior of the intermediate portion 33 of the mandrel 12 is such that the segments 188 may expand outward a sufficient amount to clear the inwardly projecting flanges 196 from the annular recess 200, thereby enabling the mandrel 12 to rapidly and freely accelerate downward. The rapid and free downward acceleration of the mandrel 12 rapidly brings the downward hammer surface 21 of the mandrel 12 in contact with the downward anvil surface 41, thereby imparting a downward jarring blow to the drilling jar 10.

To return the drilling jar to a neutral position from a downward firing position, the mandrel 12 is moved upwards until the inwardly projecting flanges 196 snap back into position within the annular recess 200. The mandrel 12 is moved upward until the collet 184 assumes the neutral position. As the mandrel 12 is moved upwards, the lower annular pressure piston 166 is urged upward by the biasing member 180. A relatively free flow of fluid from the space between the upper and lower annular pressure pistons 134 and 166 through the one way flow valve 175 permits the lower annular pressure piston 166 to translate upward to its original neutral position with relative freedom. The advantages associated with a short metering stroke discussed above with regard to the upward jarring movement are identical in the downward jarring movement mode.

Although a particular detailed embodiment of the apparatus has been described herein, it should be understood that the invention is not restricted to the details of the preferred embodiment, and many changes in design, configuration, and dimensions are possible without departing from the spirit and scope of the invention. For example the collet may be replaced by an annular retaining ring 224, which is circumferentially disposed in the annular recess 200 in the mandrel as shown in FIG. 5. The annular ring 224 is split as indicated at 226 to enable the ring 224 to expand radially outward as would the segments 188 in the above preferred embodiment. Upward or downward force from the mandrel 12 is transmitted from the annular ring 224 to the upper and lower annular pressure pistons 134 and 166 by upper and lower spacer rings 228 and 230 that are respectively disposed between the annular ring 224 and the upper annular pressure piston 134 and between the annular ring 134 and the lower annular pressure piston 166. The spacer rings 228 and 230 are shown partially cutaway to reveal the detail of the annular ring 224.

Similarly, as shown in FIG. 6, the collet 184 may be replaced by a plurality of circumferentially spaced, but separated, annular segments 232 that are disposed about the mandrel 12, shown in phantom. The annular segments 232 each have inwardly and outwardly projecting flanges 234 and inwardly projecting flanges 236 that are substantially similar in structure and function to the flanges 192 and 196. The annular segments 232 are free to move inward and outward radially as would the segments 188, though without bending.

I claim:

1. A mechanical-hydraulic double-acting drilling jar, comprising:

a mandrel;

a housing telescopingly positioned about said mandrel;

first and second pistons positioned between said mandrel and said housing and spaced longitudinally apart, said pistons respectively closing first and second substantially sealed chambers in said housing, each of said first and second pistons having first and second flow passages formed therein and extending therethrough; and a collet positioned between said mandrel and said housing and between said first and second pistons, said collet being adapted to selectively trigger said mechanical-hydraulic double-acting drilling jar.

2. The mechanical-hydraulic double-acting drilling jar, as set forth in claim 1, wherein said collet comprises:

a hollow tubular body having a plurality of longitudinally extending, circumferentially spaced slots, said slots dividing said body into a plurality of longitudinally extending and circumferentially spaced segments, each said segment having a first outwardly projecting flange and a second inwardly projecting flange.

3. The mechanical-hydraulic double-acting drilling jar, as set forth in claim 1, including a first and a second biasing members positioned between said mandrel and said housing, said first biasing member being operable to resist longitudinal movement of said first piston in a first direction, said second biasing member being operable to resist longitudinal movement of said second piston in a second direction, said second direction being opposite to said first direction.

4. The mechanical-hydraulic double-acting drilling jar, as set forth in claim 3, wherein said biasing members comprise bellville springs.

5. The mechanical-hydraulic double-acting drilling jar, as set forth in claim 1, wherein said mandrel and said housing include a first hammer and a first anvil engagable to provide a jarring force in a first direction, and a second hammer and a second anvil engagable to provide a jarring force in a second direction opposite to said first direction.

6. A mechanical-hydraulic double-acting drilling jar, comprising:

a mandrel;

a housing telescopingly positioned about said mandrel;

first and second pistons positioned between said mandrel and said housing and spaced longitudinally apart, said pistons respectively closing first and second substantially sealed chambers in said housing, each of said first and second pistons having first and second flow passages formed therein and extending therethrough;

first and second biasing members positioned between said mandrel and said housing, said first biasing member being operable to resist longitudinal movement of said first piston in a first direction, said second biasing member being operable to resist longitudinal movement of said second piston in a second direction, said second direction being opposite to said first direction; and a tubular collet positioned between said mandrel and said housing and between said first and second pistons, said collet being adapted to selectively trigger said mechanical-hydraulic double-acting drilling jar.

7. The mechanical-hydraulic double-acting drilling jar, as set forth in claim 6, wherein said collet comprises a hollow tubular body having a plurality of longitudinally extending, circumferentially spaced slots, said slots dividing said body into a plurality of longitudinally extending and circumferentially spaced segments, each said segment having a first outwardly projecting flange and a second inwardly projecting flange.

8. The mechanical-hydraulic double-acting drilling jar, as set forth in claim 6, wherein said biasing members comprise bellville springs.

9. The mechanical-hydraulic double-acting drilling jar, as set forth in claim 6, wherein said mandrel and said housing include a first hammer and a first anvil engagable to provide a jarring force in a first direction, and a second hammer and a second anvil engagable to provide a jarring force in a second direction opposite to said first direction.

10. A mechanical-hydraulic double-acting drilling jar, comprising a mandrel having a first exterior surface and a groove circumferentially disposed in said first exterior surface;

a housing telescopingly positioned about said mandrel, said housing having an interior surface, said interior surface having an inwardly projecting first flange, said first flange having a first end forming a first shoulder and a second end forming a second shoulder;

first and second pistons positioned between said mandrel and said housing and spaced longitudinally apart, said pistons respectively closing first and second substantially sealed chambers in said housing, each of said first and second pistons having first and second flow passages formed therein and extending therethrough;

first and second biasing members positioned between said mandrel and said housing, said first biasing member being operable to resist longitudinal movement of said first piston in a first direction, said second biasing member being operable to resist longitudinal movement of said second piston in a second direction, said second direction being opposite to said first direction; and a tubular collet positioned between said first and second pistons, said collet having an interior surface having at least one inwardly projecting second flange, said collet having an exterior surface having at least one outwardly projecting third flange, said collet being adapted such that said at least one inwardly projecting second flange is disposed in said circumferentially disposed groove when said at least one outwardly projecting third flange is in contact with said first flange and such that said collet expands radially when said at least one outwardly projecting third flange is moved past said first or second shoulders.

11. The mechanical-hydraulic double-acting drilling jar, as set forth in claim 10, wherein said mandrel and said housing include a first hammer and a first anvil engagable to provide a jarring force in a first direction, and a second hammer and a second anvil engagable to provide a jarring force in a second direction opposite to said first direction.

12. The mechanical-hydraulic double-acting drilling jar, as set forth in claim 10, wherein said biasing members comprise bellville springs.

* * * * *